United States Patent [19]

Malcolm et al.

[11] Patent Number: 4,896,387

[45] Date of Patent: Jan. 30, 1990

[54] INSULATED SLEEPING BAG

[75] Inventors: Richard E. Malcolm; Charles G. Shepherd, both of Oakville, Canada

[73] Assignee: Sleeping Bag Limited Partnership, Ontario, Canada

[21] Appl. No.: 174,305

[22] Filed: Mar. 28, 1988

[30] Foreign Application Priority Data

Mar. 27, 1987 [CA] Canada ..... 533230

[51] Int. Cl.[4] ..... A47G 9/00

[52] U.S. Cl. ..... 5/413; 5/450; 5/454; 5/457

[58] Field of Search ..... 5/413, 450, 457, 454; 2/69.5

[56] References Cited

U.S. PATENT DOCUMENTS

| | | | |
|---|---|---|---|
| 1,324,009 | 12/1919 | Hope | 5/413 |
| 1,919,154 | 7/1933 | Astrove | 5/413 |
| 2,620,493 | 8/1974 | Brelsford | 5/413 |
| 3,584,323 | 6/1971 | Worley | 5/413 |
| 3,831,206 | 12/1952 | Geary | 5/413 |
| 3,988,791 | 11/1976 | Simon | 5/413 |
| 4,091,482 | 5/1978 | Malcolm | 5/413 |
| 4,092,750 | 6/1978 | Ellis | 5/457 |
| 4,575,876 | 3/1986 | Weaver | 5/413 |
| 4,621,383 | 4/1986 | Gendala | 5/454 |

FOREIGN PATENT DOCUMENTS

| | | | |
|---|---|---|---|
| 207621 | 4/1939 | Sweden | 5/413 |
| 648452 | 1/1951 | United Kingdom | 5/413 |

*Primary Examiner*—Alexander Grosz

*Attorney, Agent, or Firm*—Rogers & Scott

[57] ABSTRACT

The invention provides an inflatable sleeping bag having a wall structure defining a sleeping envelope and including outer and inner skins spaced from one another in use. A shoulder cover is provided which is held in place by engaging an inflated pillow. A double zipper holds the upper and lower portions of the bag together in such a way that internal air pressure prevents the leakage of air into or out of the occupant's area of the bag. A plurality of strap structures are attached between the skins to hold the skins generally in parallel one with the other after inflation, and an insulating material is contained between the skins and located against movement by the strap structures. Inflation means is associated with the wall structure for inflating the bag and including exhaust means operable to deflate the bag. The strap structures can be used in any similar inflated structure.

10 Claims, 5 Drawing Sheets

INSULATED SLEEPING BAG

This invention relates to sleeping bags for use in all conditions including survival conditions and more particularly to structures used in controlling the spacing between skins of a pneumatically inflated structure such as a sleeping bag, the movement of air into and out of the bag while it is occupied, and controlling the shifting of the insulating material within the bag.

Sleeping bags are used in a variety of conditions. A great number of bags are used for recreational purposes in climates requiring sufficient insulation to keep the user warm in night temperatures which would rarely reach the freezing point. At the other end of the scale, some sleeping bags, are designed to be used for survival in conditions such as those found in the arctic, or at high altitude. These bags must be capable of retaining the user's body heat when exposed to external temperatures well below zero degrees Centigrade.

The present invention is for use primarily in survival sleeping bags and the following description will stress use with these bags. Because survival is a key consideration, survival bags must be designed for use by persons who have no mechanical means of transportation. The bags must consequently not only have acceptable insulation characteristics but also be capable of being folded into a size suitable for carrying and be of an acceptable weight. This invention is directed to such a sleeping bag and more particularly to structure suitable for use in the bag as well as in other inflated structures.

In the past, survival sleeping bags have generally been made of a double skin which is separated in use by an insulation material which inhibits the flow of heat from the inner skin (adjacent the user), towards the outer skin (which is exposed to the environment). Evidently for the bag to be folded into a reasonable size for carrying, any insulation used must be highly compressible, yet resilient enough to restore to its full loft after long periods of compression.

To date, the best insulating material, in terms of weight and compressibility, is down, as is known in the art. In spite of this, down has problems when used in sleeping bags, such as susceptibility to moisture, compressibility under the weight of the occupant, and the requirement for sophisticated structures to maintain the insulation in place. If the insulation moves within the bag there will be uneven places where the heat is lost locally, resulting in cold spots inside the bag. In practice, when the bag is first opened it is shaken vigorously to distribute and spread the down to ensure that it has taken on its full insulating properties. Of course as soon as the user lies in the bag, his weight will compress the down under him, reducing the thickness of insulation, and permitting relatively high loss of heat at these locations. Similarly, the hips and elbows of the user will cause local compression in the areas where these parts of the body protrude, with resultant local cooling.

Another serious problem encountered with survival bags stems from the fact that the occupant breathes, sequentially expanding and contracting the bag with his breathing motions, causing the bag to act like a bellows. This action has the effect of drawing air into and out of the bag with each breath. This movement of air occurs in the area of the occupant's neck and shoulders, and through the zippers which are used to close the bag around the occupant.

Conventional sleeping bags have many different designs of baffles intended to reduce this exchange of cold air. So called "mummy bags" do not have any zippers, and provide a drawstring to bring the opening of the bag up around the occupant's head. The penalty for this is that such bags are difficult to get into and out of.

Pneumatic bags can be inflated sufficiently to minimize the possibility of the outer and inner skins coming together due to the weight of the user lying in the bag. However, other problems result. Clearly the skins must be separated evenly and maintained in this position, otherwise when the user lies in the bag, the skins immediately under the user will come towards one another and the air displaced by this movement will cause the remainder of the skins to separate. In order to overcome this problem, various ideas have been tested to maintain equal skin separation. The most common is to use webs between the skins so that when the user lies in the sleeping bag, the forces caused by the displaced air is restricted by the webs to maintain an equal separation between the skins. Such structures have been found to have serious disadvantages. For instance, in order to make the structure stable, a great deal of webbing has to be used and its connection to the skins has proved to be less than satisfactory. Because of the geometry of the interface between the web and the skin, these two components intersect at nearly right angles. Analysis of the forces involved in such a structure would show that the tension in the fabric where the web joins the skin is very high, even though the bag is inflated to only moderate pressure. In order for the webs to hold the skins reliably in opposition to each other, this junction has to be made very strong, and of heavy material. The result is a penalty in the weight of the bag and the cost of its manufacture.

In a survival bag, it is vitally important that the surface area of the bag be kept to a minimum, since it is through this surface that heat is lost. To accomplish this, the bag must be contoured, so that the region of the feet is nearly tubular, and of a diameter approximately that of the feet. Conversely, the region of the occupant's shoulders must be contoured to an eliptical cross-section, and of sufficient diameter to accommodate the largest potential user. Thus the bag has a complex contour, which must be maintained to reasonable tolerances if the occupant is to be protected from the very low temperatures of the outside environment. In addition to maintaining the contour of the bag, the webbing must also ensure that the distance between the two skins is uniform.

In order to keep the weight of the bag to a minimum, it is desirable to use the least amount of down possible, commensurate with filling the spaces to be insulated. When an insulating material such as down is compressed, it has only a limited ability to loft back to its full volume. Thus, if most of the down in a bag shifts to one part of the bag, it will be unable to loft sufficiently to fill the vacancies it has left behind, and the occupant of the bag will be unprotected in these areas. In order to prevent such shifting of the insulating material, the bags are made with internal structures which break the region between the skins into discrete compartments, thereby preventing the down from shifting into adjacent compartments. In practice, these compartments extend across the width of the bag, and the insulation can shift freely within the compartment. It is because of this shifting that the user must take care to "fluff" the bag for a while before getting into it. It is also necessary to randomly stuff the bag into its storage container, since if the bag were consistently folded for storage, it would develop voids in the insulation.

The present invention is intended to overcome the above problems and provides an inflatable sleeping bag having a wall structure defining a sleeping envelope and including outer and inner skins spaced from one another in use. A plurality of strap structures are attached between the skins to hold the skins generally in parallel one with the other after inflation and to pull the skins into the desired contour, and an insulating material is contained between the skins and located against movement by the action of the strap structures. Inflation means is associated with the wall structure for inflating the bag and including exhaust means operable to deflate the bag. The strap structures can be used in any similar inflated structure.

A baffle means is provided to inhibit the passage of air through the zippers, comprised of a double zipper and an inter-zipper region which is held in opposition by means of the air pressure within the bag.

The movement of air across the region of the neck and shoulders is prevented by means of a shoulder cover which engages an inflated pillow, thereby forming a seal around the occupant's neck, and which locates the shoulder cover in place by virtue of the weight of the occupant's head on the pillow. Such an arrangement of shoulder cover and pillow can be used on any sleeping bag.

In order for the baffles and shoulder covers to effectively prevent the movement of air into and out of the bag, they must be precisely located. As was mentioned earlier, such precision is obtained by means of straps which run transversely between the skins. In this way, the various components all work together as a system to provide the occupant with the highest possible degree of protection from the environment. The invention will be better understood with reference to the drawings, in which.

Figure 1:
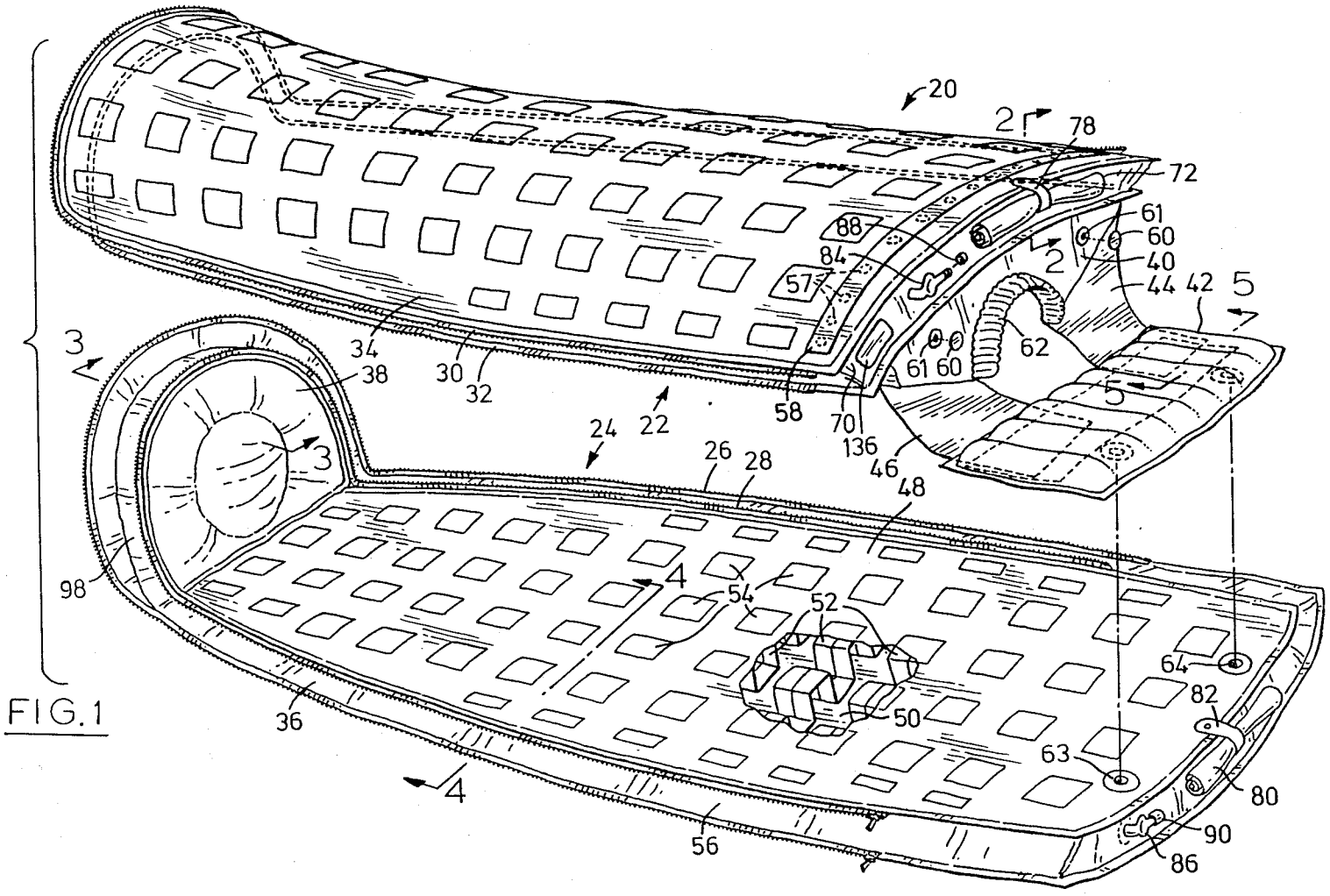
FIG. 1 is an exploded perspective view of a preferred embodiment of a sleeping bag made in accordance with the invention and showing upper and lower components of the bag.
Figure 7:
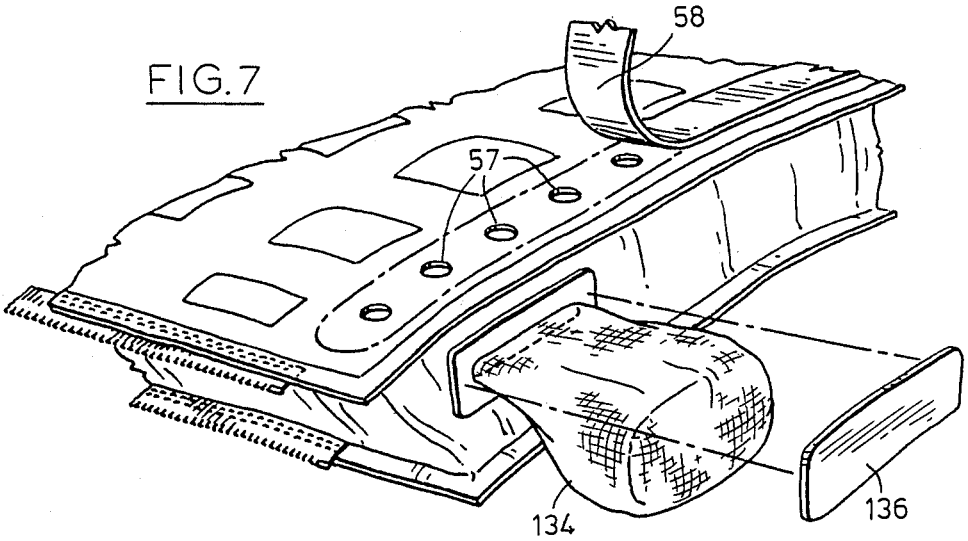
Figure 8:
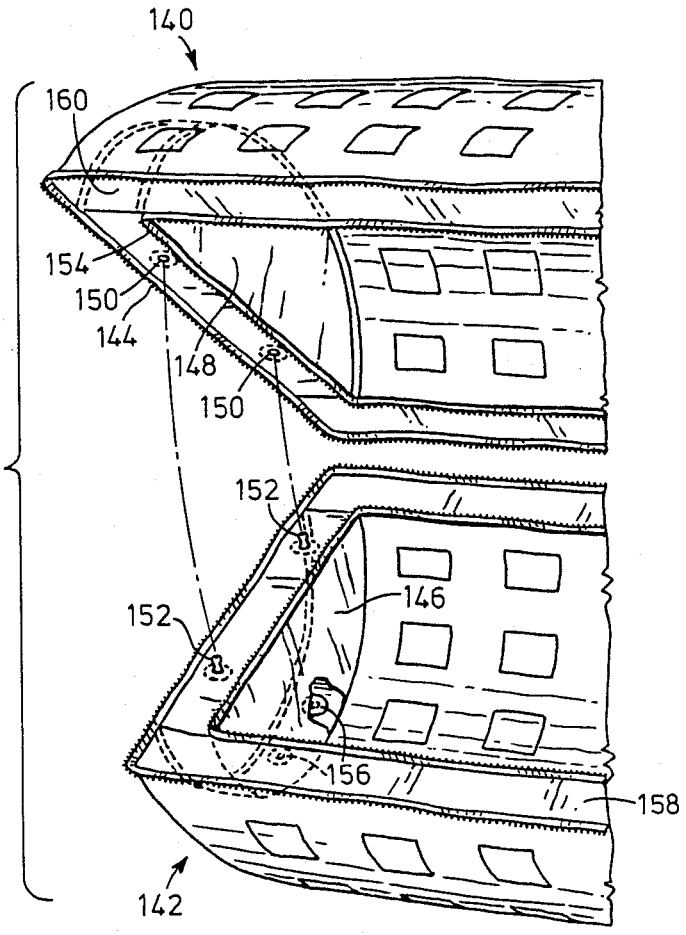

FIG. 7 is a perspective view of a portion of the upper component and illustrating parts used to place insulating down in the component; and FIG. 8 is a perspective exploded view of part of an alternative embodiment of a bag according to the invention. Reference is made first to FIG. 1 which illustrates an inflatable sleeping bag indicated generally by the numeral 20 and having respective upper and lower components 22, 24. These components contain down for insulation and in use they are attached to one another by a pair of parallel zippers made up of respective lower parts 26, 28 and upper parts 30, 32. (For convenience of illustration the components are shown inflated.) When the components are attached to one another, they define an envelope made up of a top wall 34, bottom wall 36, end wall 38, and shoulder cover 40. A pillow 42 is also provided for association with the bottom wall and arranged, as will be explained, to retain a pair of flaps 44, 46 in position to help control the location of the shoulder cover 40.

The components 22, 24 are shaped generally to be narrower near the end wall 38 where the user's feet will be accommodated. The components are of a similar construction and, as can be seen in FIG. 1, the end wall 38 is made up of respective inner and outer skins 48, 50 which are retained in position relative to one another, when the lower component 24 is inflated, by strap structures 52. These strap structures are bonded to the skins at areas indicated by rectangular areas such as the areas 54 on the inner skin and similar areas (not shown) on the outer skin. The form of the strap structure will be described in more detail with reference to FIG. 6.

The inner and outer skins 48, 50 are sealed to a side wall skin 56 which extends about the bottom wall of the lower component and continues about the end wall 38 as will be described with reference to FIG. 3. The resulting structure is a pneumatic capsule which can be inflated to define bottom and end walls. The method of inflation will be described with reference to FIG. 2.

Although not shown in the drawing in order to simplify the structure of FIG. 1, the space between the skins 48, 50 contains down to enhance the insulation of the bottom and end walls. The down is restricted from moving by the strap structures 52 which extend in parallel rows between the side wall skins 56. Similarly, down is contained between outer and inner skins of the upper component 22 which also includes similar strap structures, and which is shaped to complement the end wall 38 for connection by the zippers as will be described.

The components 22, 24 receive down through apertures such as those indicated by numeral 57 in the upper component. After down is entered, the apertures are sealed using bonded strips such as strip 58. Similarly, the shoulder cover 40 of the upper component 22 is insulated using openings 61 which are later sealed by patches 60. The shoulder cover is connected pneumatically to the upper component 20.

A knitted wool or polypropylene collar 62 is provided bordering a suitable rounded recess in the shoulder cover 40 for snug engagement about the user's neck, and the flaps 44, 46 depend from the end wall to either side of the collar 62 for engagement under the pillow 42. These flaps have a high friction co-efficient so that they will tend to be held in position under the pillow by the weight of the user's head thereby ensuring that the shoulder cover remains in position.

The pillow 42 is attached to the lower component 24 at a pair of pneumatic couplings 63, 64 which may be attached permanently or be of the releasable type. Once in place, the pillow will be inflated along with the lower component so that when the user gets into the bag by deflecting the shoulder cover upwardly and sliding into position, the cover can then be located around the neck and the flaps engaged under the pillow to ensure that there is no air flow into and out of the bag. The weight of the user will increase the air pressure in the lower portion 24, causing the pillow 42 to inflate sufficiently to support his head.

Figure 2:
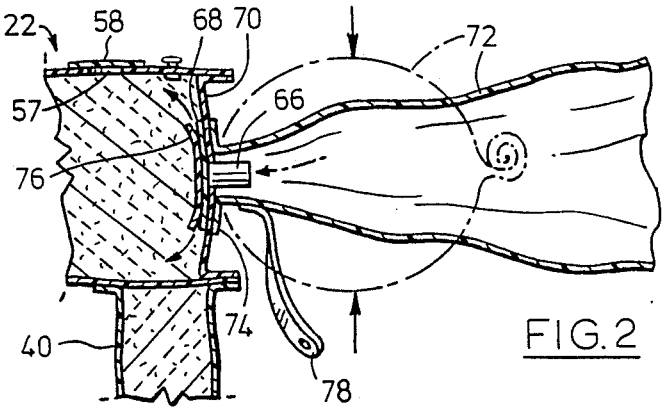
FIG. 2 is a sectional side view of a portion of the upper component drawn to a larger scale and showing a structure used to inflate this component.
Figure 3:
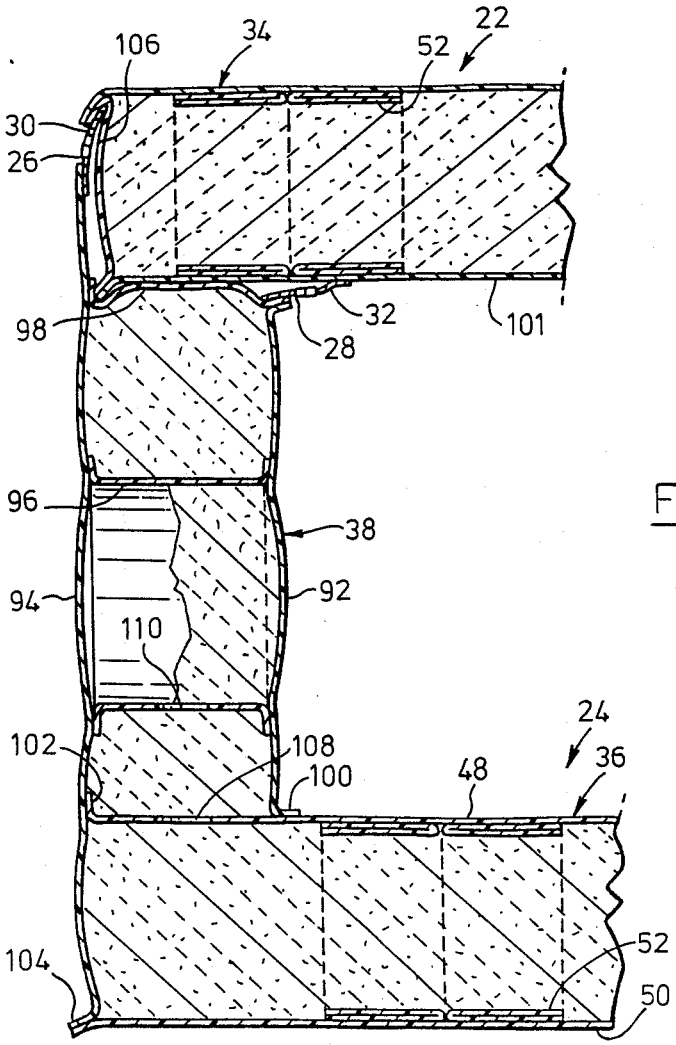
FIG. 3 is a sectional view on line 3—3 of FIG. 1 also to a larger scale and with the bag in an assembled condition.

Reference is next made to FIG. 2 to illustrate the structure used to inflate the upper component. A tubular piece 66 is attached to an annular flange 68 which is bonded to the inner surface of a side skin 70 of the upper component. The tubular piece 66 projects outwardly through the skin 70 into a generally conical sleeve 72 attached by an annular flange 74 to the outside of the skin 70. The sleeve 72 can be used to inflate the component by opening the sleeve, and then rolling it up from the outer end quickly, to displace air through the tubular piece 66 and past a simple flap valve 76 attached to the annular flange 68. (An intermediate step in this process is shown in ghost outline.) Once the air is displaced into the component, the sleeve is opened again before repeating the process until the component is inflated. After inflation the sleeve 72 is rolled up and held in position by a strap 78 in the manner shown best in FIG. 1. A similar arrangement is used to inflate the lower component and as seen in FIG. 1, a sleeve 80 is provided and held in place by a strap 82.

When it is required to deflate the sleeping bag, outlets 84, 86 are opened in respective upper and lower components. These outlets have built-in filters to retain the insulating down. The outlets are covered by removeable caps 88, 90.

Further details of the structure will now be described with reference to FIG. 3 which is a section taken on line 3—3 of FIG. 1, and passing through the end wall 38. This wall consists of inner and outer skins 92, 94 connected by a tubular element 96 and having a portion 98 of the side wall skin 56 (FIG. 1) extending about the end wall. The skin portion 98 and element 96 are welded at their ends to the inner and outer skins 92, 94 and the skin 92 terminates at its lower end (as drawn in FIG. 3) in an end piece 100 turned for surface-to-surface welding with the inner skin 48. The remainder of the skin 92 is attached to the peripheral skin portion 98 which in turn is attached to the lower part 26 of the inner zipper. The upper part 30 of the zipper is of course attached to the inner skin 101 of the upper component 22.

Outer skin 94 of the end wall 38 is attached to the inner skin 48 of bottom wall 36 at 102 and projects for connection at 104 to the outer skin 50. The outer skin 94 in effect becomes part of the bottom wall and also follows the contour of the end wall 38, projecting outwardly beyond the end wall to terminate at the lower part 26 of the outer zipper. The upper part 30 of the zipper is attached to the outer skin of the upper component 22 via an end skin 106 which seals the end of the upper component.

End wall 38 is insulated with down and connected pneumatically to the bottom wall 36 via an opening 108 in the skin 48. An opening 110 is provided in the tubular element 96 to permit equalization of pressure in the wall. Consequently, when inflating this component using the sleeve 80 (FIG. 1), air will pass through the openings 108, 110 to inflate the end wall.

The junction between the end wall 38 and the upper component 22 is an air seal caused by engagement between the peripheral skin portion 98 of the component 24 and the inner skin 101 of the wall of the upper component 22. The zippers are arranged so that they absorb the tensile reaction forces caused by pneumatic pressure which would otherwise cause the wall 38 to separate from the upper component 22. A balance is created resulting in surface contact between the upper wall and the peripheral skin portion 98 thereby preventing passage of air between these parts. A similar seal is created between the top and bottom walls along the sides of the bag as will be described with reference to FIG. 4.

Figure 4:
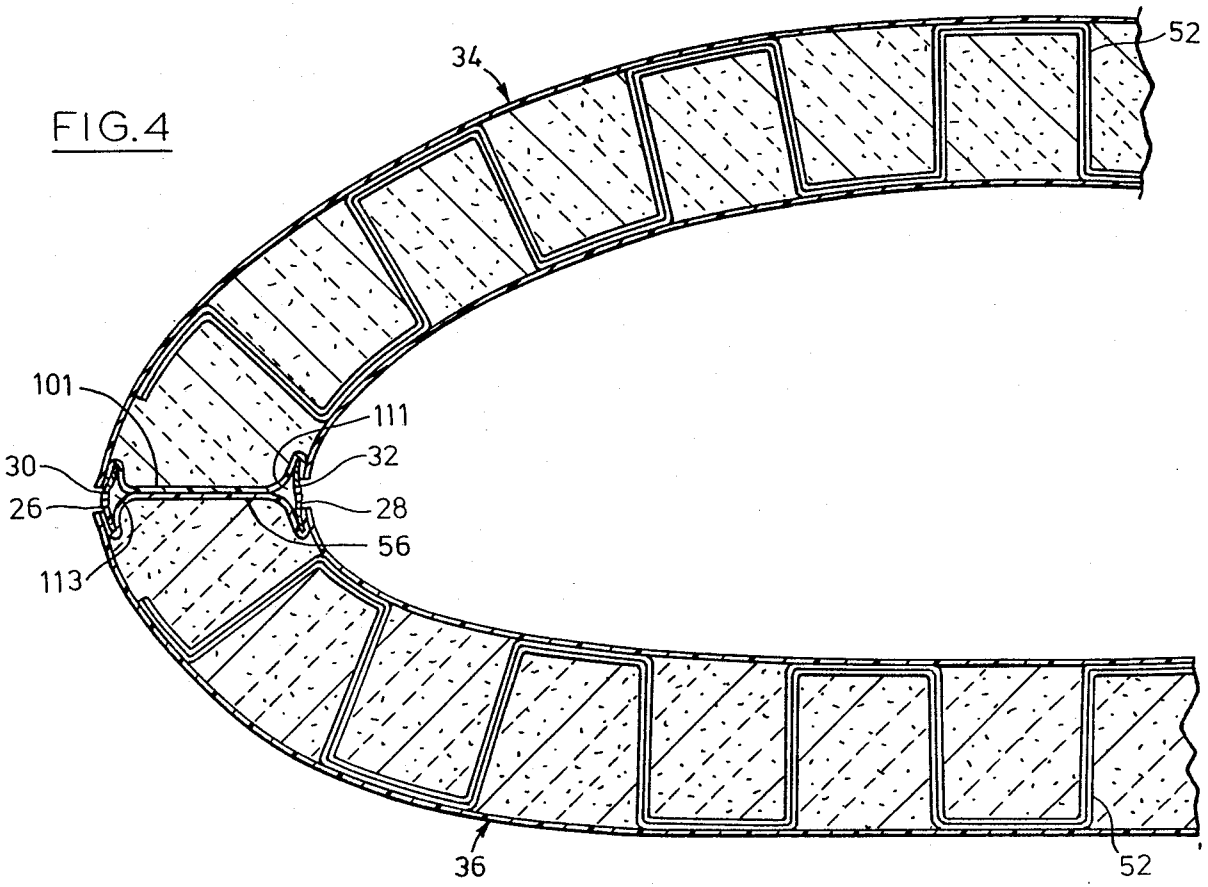
FIG. 4 is a sectional view on line 4—4 of FIG. 1, also with the bag in an assembled condition.

As seen in FIG. 4 (which is an exemplary view), the top wall 34 and bottom wall 36 meet at their edges. The side wall skin 56 of the bottom component meets the side wall skin of the upper component 101 in surface-to-surface contact held in place by the inner and outer zippers made up of the respective lower parts 26, 28 and upper parts 30, 32. These zippers are protected by the structure in that they are attached to the respective inner and outer skins with an overlap by these skins to partly cover the zippers so that the zippers are effectively in respective pockets 111, 113. Again, pneumatic pressure tends to separate the zippers and the reactive force of the zippers ensures that the side wall skin 56 and inner skin 101 are in tight surface-to-surface contact thereby preventing flow of air between the walls. This engagement can be enhanced by making the skin of the lower component 56 wider than the skin of the upper component 101. The wider one will then have excess material available to bow outwardly under pressure from the occupant's weight into firm engagement with the skin of the upper component.

Figure 5:
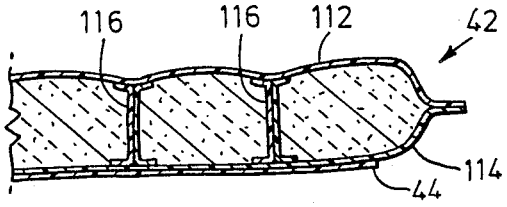
FIG. 5 is a sectional view on line 5—5 of FIG. 1.

Reference is next made to FIG. 5 which illustrates a typical sectional view through the pillow 42 shown in FIG. 1. It will be seen that the pillow rests on flap 44 and consists of upper and lower skins 112, 114 connected to one another by webs 116 of conventional construction. The pillow is insulated and, as previously described, is inflated by connection to the bottom wall via couplings 63, 64 (FIG. 1).

Figure 6:
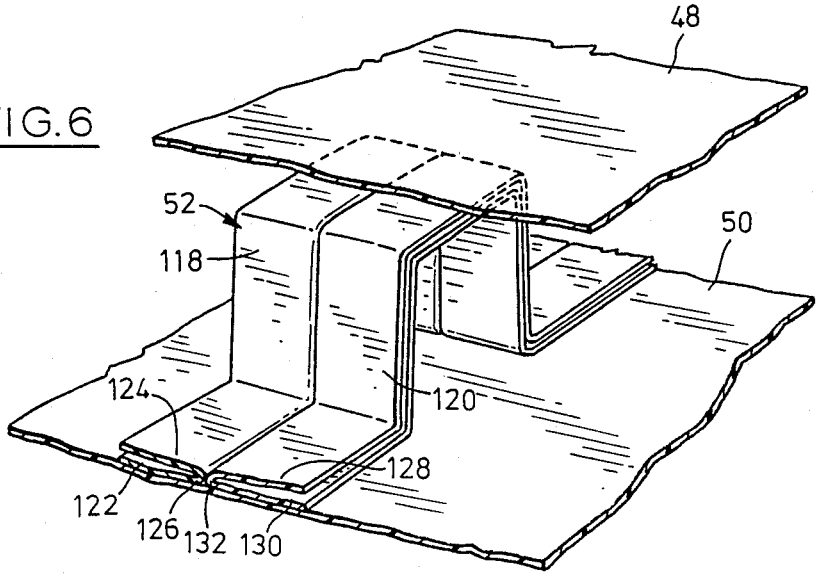
FIG. 6 is a typical portion of the components drawn in perspective to illustrate portions of a strap structure used in the components.

Reference is next made to FIG. 6 to describe the strap structures 52, of which a portion is shown in this figure. Referring momentarily to FIG. 1 it will be seen that each of the strap structures is made from a pair of strips of material extending across from one side of the wall to the other in a series of parallel and transverse elements, adjacent parallel elements being spaced longitudinally from one another and separated by a transverse element. The portion shown in FIG. 6 illustrates to a larger scale than that used in FIG. 1 how the strips are folded.

As seen in FIG. 6, the strap structure consists of first and second strips 118, 120 each of which is of double thickness with a fold adjacent the other strip. More particularly, the strip 118 has an outer layer 122 and inner layer 124 joined at a fold 126, and the strip 120 has an inner layer 128, outer layer 130, and fold 132. It will be evident that because of this arrangement, the surface-to-surface welding of the strap structure to the inner and outer skins 48, 50 will mean that the inner layers 124, 128 are attached to the inner skin 48 whereas the outer layers 122, 130 are attached to the outer skin 50.

Before describing the strap structure in more detail, it will be helpful in understanding it to discuss some prior art structures and their disadvantages. In the past, strap structures of similar overall shape have been used but formed from one single thickness of material which is bonded both to the inner and to the outer skins. When pneumatic pressure is applied, the forces tending to separate the inner and outer skins are resisted by the strap structure acting at lines where the skins meet the strap structures. Furthermore, because the forces distort the skins, the forces are concentrated at one end of said line. There is a resultant tendency for the strap to be separated by a peeling action from the skins, and this tendency is exacerbated by a person applying his weight locally thereby displacing air towards other parts of the bag where the pressure is increased and the loads on the straps in these parts are also increased. Because of the right-angled intersection of strap and skin, the forces tending to peel the strap from the skin can be very high, requiring heavy materials and costly bonding techniques.

By contrast with the prior art, the present strap structure has double layers incorporating unusual stress-distributing characteristics.

Consider a separating load applied between the skins 48 and 50 of FIG. 6 and it will be seen that the inner skin 48 tends to pull the inner layers 124, 128 upwardly and the outer skin 50 tends to pull the outer layers downwardly (as shown). This creates a combination of stresses in the straps distributed by the folds 126, 132 to minimize local stresses where the transverse portions meet the parallel portions. The straps depicted in FIG. 6 are folded at 126 and 132, so that the tension caused by the forces in the skins must pass through the folds. The resulting distortion of the straps causes the tension to be distributed along the entire line of contact between strap and skin, thereby greatly reducing the tendency to peel the strap away from the skin. A further benefit arises from the tension traversing the fold in the straps. The distribution of the forces within the straps causes them to spread open in the center, between the skins. The resulting "vanes" act to inhibit the shifting of the insulating material within the bag. This causes the material to maintain its uniform distribution within the bag, even after repeated shaking or folding.

The strap structures are used in the bottom and top walls but could also be used in the pillow and end walls if preferred. It has been found unnecessary to do this in practice because the stress problems arise primarily because a person sits on top of an inflated bag or lies inside it.

Reference is next made to FIG. 7 which illustrates a structure used to place the down in the bag during manufacture. The top wall is shown and as exemplary of both walls. The apertures 57 can be seen with the strip 58 about to cover the apertures which provide access for hollow wands through which the down is blown. The wands are withdrawn slowly as the down is blown from the wands, the walls are filled with a predetermined volume of down. Once the down is in place, the tape 56 is bonded to the skin of the wall to retain the down in position permanently and also to provide a pneumatic seal. In the case of the end wall, this can be filled in a similar fashion and, because of its pneumatic connection to the bottom wall, it will be inflated in conjunction with the bottom wall.

A down proof, permeable fabric bag is provided attached to the end of the wall, to permit the air to escape while the down is being blown into the bag, in the manner of a vacuum cleaner bag. Once the filling is complete, the bag 134 is stuffed inside, and a pneumatic seal 136 is applied.

It will be clear from the foregoing description that when the bag is in use after inflation, air is trapped between the outer and inner skins and is limited from moving freely by the presence of the down. Further, because of the novel strap structures, local body loads on the lower component 24 of the bag will cause an increase in pressure of air in this component and this will tend to separate the skins in regions not directly under the user. The strap structures both minimize stresses in the skins caused by this tendency to separate and also maintain the skins substantially in their parallel relationship. This resistance to deformation means that the user's body weight cannot deflect the skins into contact with one another, and this, combined with the effect of the down results in a very efficient insulation separating the user from a supporting surface such as the ground. Also, because a similar structure is used throughout the bag, the thickness of the structure is maintained uniformly, providing excellent insulation, minimizing body heat loss, and enhancing survival prospects. The straps effectively control the overall shape or contour of the bag ensuring that all the components inter-relate accurately, thereby reducing to the greatest possible extent the loss of heat from the occupant to the environment.

The skins of the sleeping bag are preferably of nylon cloth of weight 1.1 to 1.5 oz. and coated in up to three layers of urethane to bring the weight up to about 6 oz.

The strap structure described particularly with reference to FIG. 6 could of course also be used in structures such as pneumatic mattresses where separation of the skins is also to be controlled. In the past, complex structures have been used because of the difficulty of providing sufficient strength in the strap structures to limit the possibility of breakage and separation from the skins where they are connected to the skins. The present structure is an improvement over prior art, and can be used in air mattresses and other structures having similar disadvantages and problems. The exemplary sleeping bag could take many forms and one such variation is shown partly in FIG. 8 which is a view corresponding to the foot end of the structure described with reference to FIG. 1. As seen in FIG. 8, a top component 140 mates with a bottom component 142 using peripheral zippers 144 and 154 in similar fashion to that described with reference to FIG. 1. However, in this instance, the bag includes a first end wall 146 of generally semi-circular shape and a second end wall 148 of similar shape. The end wall 146 is pneumatically connected to the bottom component 142 and receives air from that component via connectors 156. The end wall 148 has a similar pair of receptors 150 for combining with nipples 152 attached to the bottom component and provided to make pneumatic contact between the first wall 146 and second wall 148 whereby in use, air is provided to the wall 148 from the bottom component 142. It has been found that this arrangement simplifies the manufacture insofar as the application of the zipper is concerned and is desirable from this standpoint. In the embodiment where the inter-zipper skin 158 of the lower component is wider than the inter-zipper skin of the upper component 160, then the thickness of the entire lower end wall 146 should match the skin width 158, so as to make the fabrication of the components less complex.

The foregoing embodiments are typical of structures encompassing the invention as claimed.

We claim:

1. An inflatable sleeping bag comprising:

an inflatable upper component having inner and outer skins and means limiting the separation of the skins when inflated, the upper compartment having a natural curved configuration when inflated to cover a user without support by the user;

a lower component coupled to the upper component to define a sleeping envelope and an opening for entry where the user's head and shoulder's will be positioned;

a shoulder cover dependent from the upper component and defining a neck collar and two flaps, one to each side of the user's neck;

an inflatable pillow support on said flaps; and means locating the flaps on the lower component to substantially seal the envelope when the user is inside and the neck collar is about the user's neck.

2. An inflatable sleeping bag as claimed in claim 1 in which the envelope is narrower at the end remote from the shoulder cover than at the shoulder cover.

3. An inflatable sleeping bag comprising:

a sleeping envelope having outer and inner skins spaced from one another in use;

a plurality of strap structures attached between the skins to hold the skins generally in parallel one with the other after inflation and when in use, the strap structures being pairs of strips assembled side by side in allochiral relationship with each strip being of a flexible material in two layers, the layers being joined along an edge of the strip adjacent the other of the pair of strips and the strip having parallel elements separated from one another by transverse elements, and adjacent parallel elements being spaced longitudinally from one another and attached one to the outer skin and the adjacent element to the inner skin by the other layer of the strip;

an insulating material contained between the skins and positioned about the strap structures; and air pressure means associated with the envelope for inflating and deflating the bag.

4. A sleeping bag as claimed in claim 3 in which the envelope comprises upper and lower components and zipper means coupled to the components for attaching the components to one another in use.

5. A sleeping bag as claimed in claim 3 in which the insulating material is natural down.

6. A sleeping bag as claimed in claim 3 in which the air pressure means is at least one sleeve communicating with the envelope, the sleeve having an open outer end so that air contained therein can be displaced into the envelope between the skins by rolling up the sleeve starting at the outer end of the sleeve.

7. A sleeping bag as claimed in claim 3 in which the envelope comprises upper and lower components connected in use by outer and inner zipper means, the components being put into surface-to-surface contact between the zipper means to seal the components to one another.

8. A sleeping bag as claimed in claim 3 and further comprising a pneumatic pillow, inflatably connected to the bag.

9. An inflatable sleeping bag comprising:

a sleeping envelope having outer and inner skins spaced from one another in use, the envelope having an upper and lower components and zipper means coupled to the components for attaching the components to one another in use, a neck collar, shoulder cover, and flaps, one to each side of the neck collar, the bag further comprising a pneumatic pillow which in use rests on the flaps to retain the neck collar in place and to thereby minimize the likelihood of air passage about the user's neck;

a plurality of strap structures attached between the skins to hold the skins generally in parallel one with the other after inflation and when in use;

an insulating material contained between the skins and positioned about the strap structures; and air pressure means associated with the envelope for inflating and deflating the bag.

10. An inflatable sleeping bag comprising:

upper and lower inflatable components;

inner and outer zipper means coupled to the upper and lower components and spaced from one another so that on inflation portions of the components between the zipper means come into contact with each other to provide a seal between the components;

a neck collar, shoulder cover, and flaps, one to each side of the neck collar; and a pillow for location on the flaps to retain the neck collar in place and minimize the likelihood of air passage about the user's neck.

* * * * *